US006129611A

United States Patent [19]

Yamaguchi

[11] Patent Number: 6,129,611

[45] Date of Patent: Oct. 10, 2000

[54] GOLF BALL BUFFING APPARATUS AND METHOD

[75] Inventor: Takehiko Yamaguchi, Chichibu, Japan

[73] Assignee: Bridgestone Sports Co., Ltd, Tokyo, Japan

[21] Appl. No.: 09/320,552

[22] Filed: May 27, 1999

[30] Foreign Application Priority Data

May 28, 1998 [JP] Japan ..... 10-164309

[51] Int. Cl.[7] ..... B24B 11/10

[52] U.S. Cl. ..... 451/50; 451/278

[58] Field of Search ..... 451/50, 103, 283, 451/549, 438–439, 278; 15/21.2

[56] References Cited

U.S. PATENT DOCUMENTS

| | | | |
|---|---|---|---|
| 2,405,344 | 8/1946 | Cloutier | 451/50 |
| 2,438,773 | 3/1948 | Warlick | 451/317 |
| 2,479,898 | 8/1949 | Beaudette | 15/21.2 |
| 3,085,476 | 4/1963 | Sloan et al. | 451/439 |
| 3,106,113 | 10/1963 | Arpaio, Jr. et al. | 451/388 |
| 3,111,789 | 11/1963 | Harmon | 451/211 |
| 3,133,383 | 5/1964 | Chapman | 451/50 |
| 3,167,884 | 2/1965 | Thompson | 451/50 |
| 3,640,028 | 2/1972 | Richard | 451/50 |
| 5,484,329 | 1/1996 | Engelbrektson | 451/50 |
| 5,611,723 | 3/1997 | Mitoma et al. | 451/50 |
| 5,658,188 | 8/1997 | Yamada et al. | 451/50 |

FOREIGN PATENT DOCUMENTS

| | | | |
|---|---|---|---|
| 63-109880 | 5/1988 | Japan . | |
| 1404283 | 6/1988 | U.S.S.R. | 451/50 |

*Primary Examiner*—Robert A. Rose

*Attorney, Agent, or Firm*—Sughrue, Mion, Zinn, Macpeak & Seas, PLLC

[57] ABSTRACT

A golf ball buffing apparatus includes a holder for holding a golf ball and an assembly for buffing the surface of the golf ball. The buffing assembly mounted for motion toward and away from the golf ball includes a rotating shaft; a buffing head affixed to one end of the rotating shaft and having a buffing face shaped in substantial conformity with the surface of the golf ball; and a guide assembly having a plurality of following faces that are disposed radially outward from the buffing head and substantially coincide with the extended shape of the buffing face. The buffing head and the guide assembly are movable together in the axial direction of the shaft. The apparatus can efficiently buff only selected portions on the surface of the golf ball where burrs are formed.

12 Claims, 5 Drawing Sheets

GOLF BALL BUFFING APPARATUS AND METHOD

The present invention relates to a golf ball buffing apparatus which can efficiently buff only selected portions on the surface of a golf ball. It also relates to a method for buffing golf balls using the apparatus.

BACKGROUND OF THE INVENTION

In both golf balls having a two-piece construction comprising a core and a cover and golf balls of multilayer construction comprising a core and two or more cover layers, the cover is generally injection-molded from a thermoplastic resin material.

The injection molding process is typically carried out, as shown in FIG. 4, using an injection mold 1 comprising upper and lower sections 2 and 3, both made of metal, which are removably mated to define a spherical cavity 4 at the interior.

Described below is one example relating to the formation of a cover around a core in the production of a two-piece golf ball. The cavity 4 within the mold 1 is defined by walls 7 on which are provided numerous projections (not shown) for embossing dimples on the surface of the cover, which is also the surface of the ball. The mold 1 has a parting line PL between the upper and lower halves 2 and 3 at a position corresponding to the equator H of the cavity 4. Referring to FIGS. 4 and 5, three core support pins 6 are disposed at the apexes of each of two equilateral triangles T centered respectively on the north and south poles of the spherical cavity 4. The core support pins 6 are extended into the cavity 4 in a direction perpendicular to the parting line PL of the mold 1, for supporting a core 5 at the center of the cavity. A gas venting pin hole 9 is provided in the mold at each of the two polar positions of the spherical cavity 4 and a gas venting pin 10 is received therein. These holes and pins are situated at the positions furtherest removed from cover stock injecting gates located near the mold parting line PL.

Injection molding is carried out in this mold by injecting the cover stock through the gates (not shown) located near the parting line PL. Just before injection of the cover stock ends, the core support pins are retracted so that the ends of the pins lie flush with the cavity wall. Injection molding is then completed.

During injection molding, the air present between the cavity wall 7 and the core 5 is vented through gaps between the gas venting pins 10 and the gas venting pin holes 9 and through gaps between the core support pins 6 and core support pin holes 6*a*, as seen from FIGS. 4 and 5. When this venting of gases or degassing takes place, some of the cover stock makes its way into the gaps, where it hardens, resulting in the formation of burrs at positions corresponding to the gaps.

Burrs that have formed locally on the surface of a golf ball in this manner can be removed in various ways. One such technique is a grinding method that makes use of a grinding apparatus comprising a plurality of shafts, each formed of a grindstone at the end face thereof (see JP-A 109880/1988).

This method grinds the surface of a golf ball G using a grinding apparatus 60 as shown in FIGS. 6 and 7. The apparatus 60 includes three shafts 62 disposed on the same plane at 120° intervals so that the center axes of all three shafts meet at the center O of a golf ball G seated in a golf ball holder (not shown). Each shaft 62 is movable in its axial direction and rotatable about its own axis. Each shaft 62 has an end face 64 which is formed as a concave spherical surface of the same curvature as the surface of the golf ball G so that the face is engageable with the golf ball surface and hence, serves as a buffing face. The apparatus 60 further includes a mechanism for moving the shafts 62 in their respective axial directions and rotating the shafts about their respective axes. A disc-shaped recess 66 is provided at the center of each buffing face 64.

With this apparatus, grinding is carried out by pushing the shafts against the ball while rotating each shaft in the same direction. Grinding is performed while mutually varying the pressure against the ball and/or rotational speed of each of the three shafts. This causes the ball to turn during grinding, enabling the entire surface of the ball to be uniformly ground.

However, this prior-art method grinds not only those regions of the ball's surface having burrs, but even regions of the surface having no burrs. This undesirably compromises the flight performance of the ball.

In general, a golf ball is provided on its surface with numerous dimples to enhance flight performance of the ball. These dimples are usually formed to predetermined depths at a tolerance of within ±5 microns. However, if the entire surface of the ball is ground, including areas without burrs, the grinding operation destroys the precision that has been carefully imparted to the dimple-bearing surface of the ball. The resulting decline in the precision of the ball's surface, and especially in the precision of the dimple depths, causes the golf ball, when hit, to rise too sharply or to deviate right or left, which is evidence of a deterioration in the flight performance.

SUMMARY OF THE INVENTION

It is, therefore, an object of the present invention to provide a golf ball buffing apparatus capable of efficiently buffing only selected portions of the surface of a golf ball. Another object of the invention is to provide a method for buffing golf balls using this buffing apparatus.

In one aspect, the invention provides a golf ball buffing apparatus comprising means for holding a golf ball having an outside surface, and means for buffing the outside surface of the golf ball. The buffing means is movable toward and away from the golf ball and includes a rotating shaft, a buffing head mounted on one end of the rotating shaft and having a buffing face shaped in substantial conformity with the outside surface of the golf ball, and a guide assembly having a following face that is disposed radially outward from the buffing head and substantially coincides with the extended shape of the buffing face. The buffing head and the guide assembly are movable together in the axial direction of the rotating shaft.

In one preferred embodiment, the guide assembly has a plurality of circumferentially spaced-apart following faces. In another preferred embodiment, the guide assembly comprises a plurality of follower rollers which are rotatable about a pivot. The follower rollers rotate over the ball and about the pivot, either together with rotation of the buffing head or independently.

In another aspect, the invention provides a method for buffing a golf ball, comprising the steps of:

(a) holding a golf ball having an outside surface with holder means;

(b) pushing buffing means against the golf ball, the buffing means being movable toward and away from the golf ball and including a rotating shaft, a buffing head mounted on one end of the rotating shaft and having a buffing face shaped in substantial conformity with the outside surface of the golf ball, and a guide assembly having a following face that is disposed radially outward from the buffing head and substantially coincides with the extended shape of the buffing face, and (c) rotating the rotating shaft, and hence the buffing head for buffing the golf ball with the buffing face.

The invention additionally provides golf balls buffed by the foregoing method.

The invention minimizes buffing in regions of a golf ball's surface other than those having burrs. As a result, the surface shape of the ball, especially the depth of the dimples, specified by the ball's design is substantially unaffected, thereby avoiding adverse effects to the flight performance of the ball.

Specifically, during buffing of a golf ball using the buffing apparatus of the invention, when the guide assembly is up against the ball surface, the buffing head cannot substantially move forward from that position. This makes it possible to reliably prevent excessive buffing of the ball's surface, and to carry out accurate buffing only in those regions that require buffing, particularly those regions where burrs are formed at the positions of core support pins and venting pins near the two poles. Consequently, the surface shape of the ball, especially the depth of the dimples, specified by the ball's design can be maintained to a high degree of precision, giving full play to the dimple effects and preventing any loss in flight performance.

Particularly when the cover is formed over the core by injection molding, burrs that arise only at the positions of core support pins and venting pins near both poles can be reliably buffed away without compromising the depth of the dimples.

In the golf balls buffed by the method of the invention, the dimple depth is maintained equal over the entire surface of the ball. The ball has an excellent flight performance in that when hit, it does not rise too sharply or deviate left or right, and an outstanding appearance, and is thus of high quality.

BRIEF DESCRIPTION OF THE DRAWINGS

The objects, features and advantages of the invention will become more apparent from the following detailed description, taken in conjunction with the accompanying drawings.

DETAILED DESCRIPTION OF THE INVENTION

Figure 1:
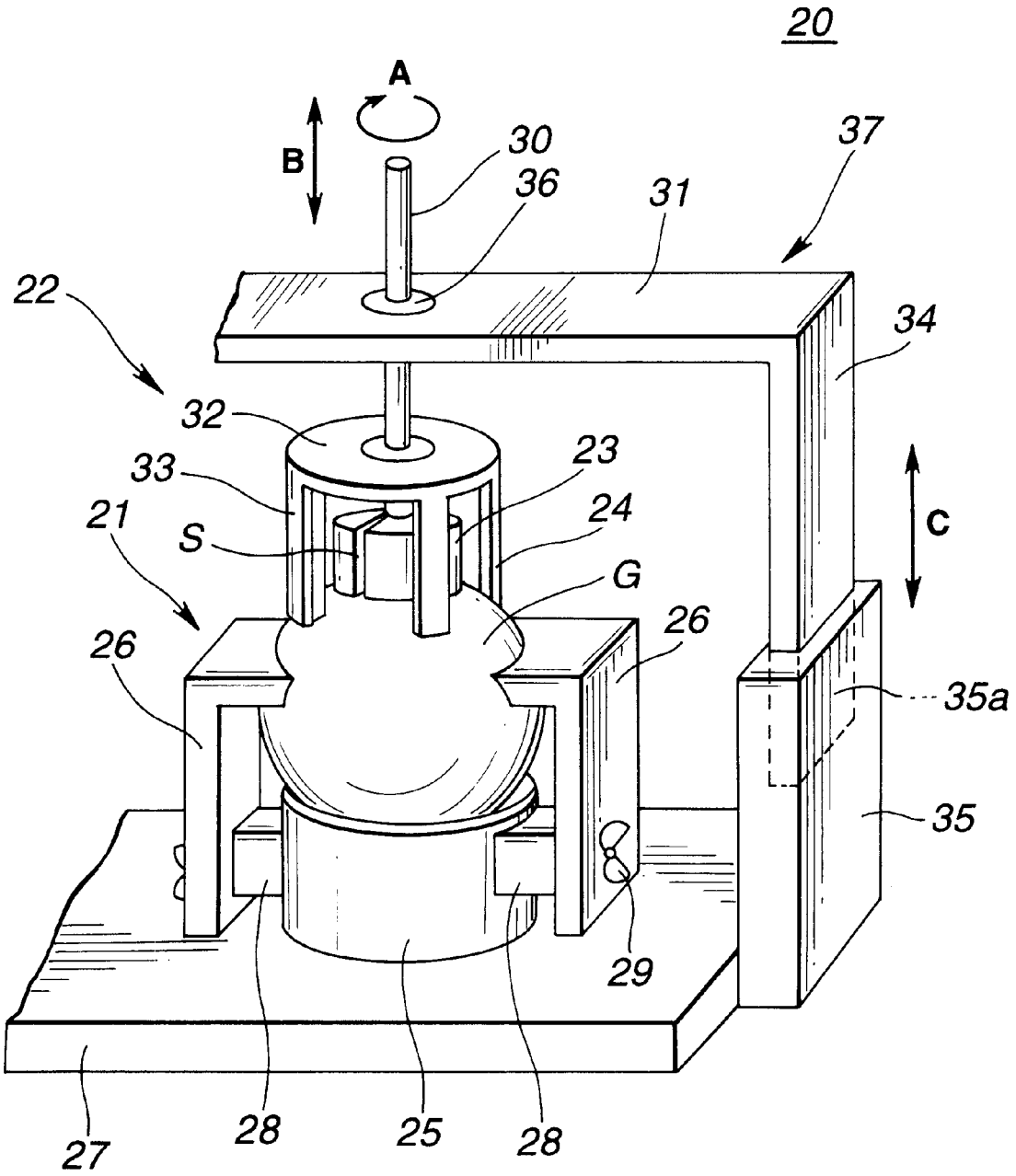
FIG. 1 is a perspective view showing a golf ball buffing apparatus according to one embodiment of the present invention.
Figure 2:
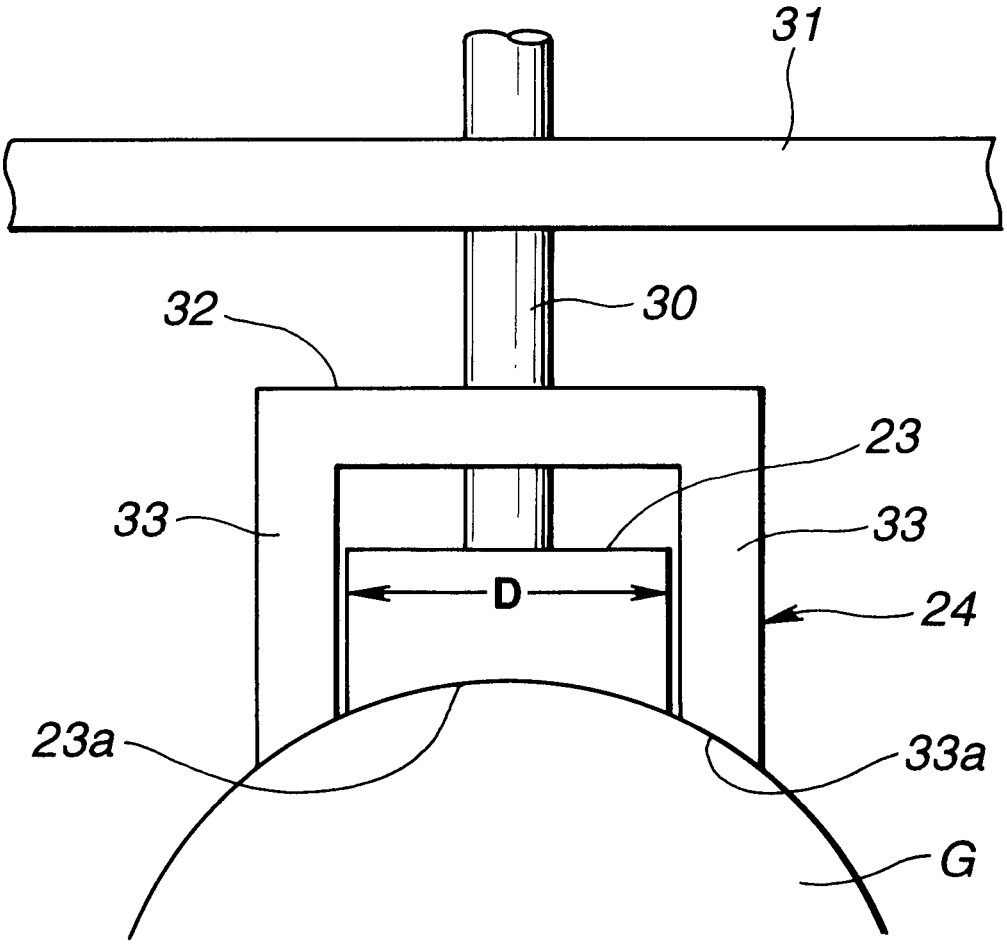
FIG. 2 is an enlarged side view of the buffing means in the embodiment of FIG. 1.

Referring to FIG. 1, there is illustrated in perspective view a golf ball buffing apparatus according to one embodiment of the invention. The apparatus is generally designated at 20 and designed for buffing a golf ball G, more specifically buffing away burrs that are formed on the ball surface at and in the vicinity of one of the poles of the golf ball G. The golf ball buffing apparatus 20 includes a base 27, a ball holding means 21 secured thereto, and a buffing means 22. FIG. 2 is an enlarged side view showing the buffing means of the same apparatus. Although not shown in the diagrams, numerous dimples are formed on the surface of the golf ball G.

In the golf ball buffing apparatus 20, the buffing means 22 is disposed so as to be movable toward and away from at least one polar area of the golf ball G. One alternative not shown in the diagrams is to have the golf ball G held near its equator by the holding means 21, and to provide a pair of buffing means 22 at both polar positions of the ball G. However, it is recommended that a single buffing means 22 be provided, as shown in FIG. 1, in a manner allowing it to move toward and away from one of the polar positions of the ball G (the north pole position in FIG. 1). In this embodiment, first the north pole region of the ball G is buffed, following which the ball is rotated 180 degrees and the south pole region is buffed.

The ball holding means 21 includes a ball holding platform 25 on the base 27. The platform 25 at its top side has a curved surface that corresponds with the surface shape of the golf ball G. Specifically, the platform 25 at its top side has a hollow or recess which matches the curved surface of the ball and on which the ball is seated. The ball holding means 21 further includes a pair of arms 28, 28 which are laterally extended to the left and right, respectively, from either side of the platform 25, and a pair of inverted L-shaped ball retainers 26, 26 having legs which are each removably fastened to the end faces of the laterally extending arms 28, 28 with screws 29. The end faces of the ball retainers 26, 26 are formed in a shape adapted to the curved surface of the golf ball G. When the ball G is seated on the recess of the holding platform 25 such that the axis passing through both poles of the ball G is substantially vertical, and the retainers 26, 26 are fastened to the holding platform 25 with the screws 29, the retainers 26, 26 approach the ball G and together grip it in the vicinity of the equatorial plane so that the ball is tightly held on the platform 25.

The buffing means 22 includes a supporting column 35 secured to the base 27, an overhead support 37 provided on the support column, and a vertically extending rotating shaft 30 rotatably mounted in the support 37 via a bearing 36. A buffing head 23 and a guide assembly 24 are mounted on the lower end of the rotating shaft 30 and the buffing head 23 may rotate integrally with the shaft 30.

The rotating shaft 30 is coupled to a driving means (not shown), which drives the rotating shaft 30 to rotate in the direction of the arrow A in FIG. 1, or in the opposite direction.

The rotating shaft 30 is provided to be movable in the axial direction thereof. In one exemplary means that may be used for this purpose, two supporting columns 35 are provided on either side of the base 27, and the support 37 forms a generally U shape having a horizontal top plate 31 and a pair of vertical legs 34 integrally united to either end of the top plate 31 (FIG. 1 shows the supporting column 35 and leg 34 on only one side). The legs 34 are slidably inserted into slots 35*a* which are downwardly formed in the supporting columns 35 from the upper end faces thereof. Then, the legs 34 can be raised and lowered in the direction of the arrow C in FIG. 1 by a driving means (not shown), thereby raising and lowering the rotating shaft 30 which is rotatably supported by the bearing 36 in the top plate 31 integrally united with the legs 34. Alternatively, the support 37 is fixedly secured to the supporting columns 35, and the rotating shaft 30 is mounted in the support 37 for both rotation and axial motion so that the rotating shaft may be moved up and down in the direction of the arrow B by a suitable driving means.

In an alternative arrangement (not shown), instead of mounting the guide assembly 24 on the lower end of the rotating shaft 30, the guide assembly 24 may be secured to the top plate 31. More particularly, the guide assembly 24 has a guide plate 32 whose top is fixedly secured to the lower side of the top plate 31. Then the guide assembly 24 can be moved up and down integrally with the support 37.

As best shown in FIG. 2, the buffing head 23 is mounted on the lower end of the vertical rotating shaft 30 and has a buffing face 23*a* which is shaped substantially like the outside surface of the golf ball G; that is, a shape which has the same curvature as the surface of the ball and fits with the ball's surface.

The buffing head 23 is composed of a cylindrical grindstone which is generally divided into from two to twelve segments. The segments in the buffing head 23 are separated by spaces S, which allow grinding debris to escape to the exterior therethrough. If necessary, the buffing head 23 may be so constructed so that only the end face (23*a*) portion thereof which contacts the golf ball is a grindstone. The buffing head generally has a diameter D within the range of 15 to 30 mm, which enables coverage of the core support pin hole positions where burrs form. In the illustrated embodiment, the buffing head has a cylindrical shape with a diameter D of 24 mm, and is comprised of six segments.

The buffing face 23*a* of the buffing head 23 need not necessarily be composed of a grindstone, and may instead have a construction in which cutters or tool blades are set within the buffing face, provided the objects of the invention are attainable.

The guide assembly 24 includes a guide disc 32 which is centered on the rotating shaft 30 and a plurality of follower members 33 which are situated radially outward from and concentric with the buffing head 23, and extended vertically downward from the periphery of the guide disc 32. Each follower member 33 at its lower end has a following face 33*a* with a shape that substantially matches the curved surface of the ball. An elastomer such as rubber may be attached to the following faces 33*a* of the guide assembly 24 to keep the surface of the ball from being scratched. In the illustrated embodiment, the guide assembly 24 has four follower members 33 which project downward from the periphery of the guide plate 32.

The guide assembly 24 is not limited to the embodiment shown in FIGS. 1 and 2. For example, the guide assembly as a whole may have a cylindrical shape that is open at the bottom. In this case, the following face is annular and continuous.

Figure 3:
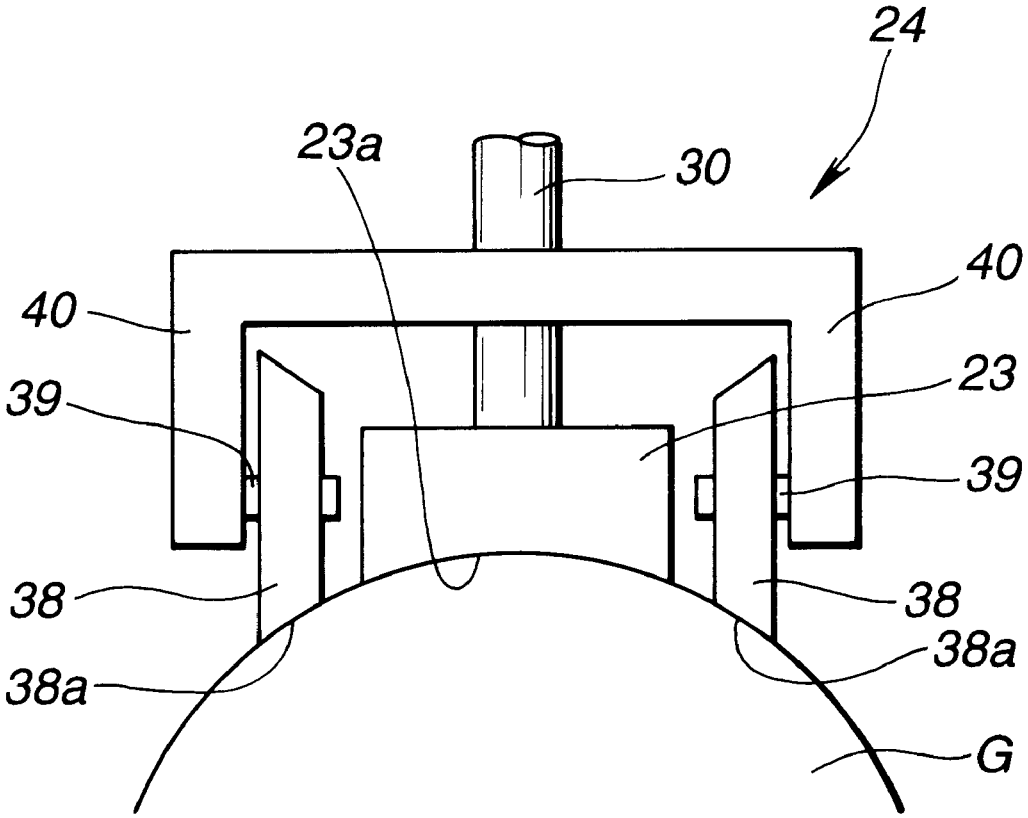
FIG. 3 is an enlarged side view showing the buffing means in another embodiment of the invention.

Alternatively, as shown in FIG. 3, the guide assembly 24 includes a U-shaped member 40 and a plurality of follower rollers 38 which are rotatably mounted to side walls of the member 40 by horizontal pivots 39. Each follower roller 38 is capable of rotating over a substantially extension line of the buffing face 23*a* of the buffing head 23 and about the pivot 39. Also, each follower roller 38 has a following face 38*a* which is substantially the same shape as the curved surface of the golf ball G.

In these embodiments, the level of the following faces 33*a* or 38*a* on the follower members 33 or 38 of the guide assembly 24 is preferably set on an extension line of the buffing face 23*a* of the buffing head 23 (i.e., at the same level), or is projected out slightly beyond a level of buffing face 23*a* of the buffing head 23 in the axial direction (i.e., toward the ball G).

In the embodiment shown in FIG. 3, a pair of annular follower rollers 38 of the guide assembly 24 are positioned 180° apart from each other, although it is possible to place instead four follower rollers 38 at 90° intervals or three such rollers at 120° intervals.

The buffing apparatus 20 of the invention is operated as follows. First of all, a golf ball G is firmly held by the ball holding means 21 in such a manner that the burrs which form only at the core support pin and venting pin positions and which are to be buffed down are situated at the north pole position. By actuating a drive (not shown), the rotating shaft 30 is rotated in the direction of the arrow A or in the opposite direction at a rotational speed generally within a range of 1,000 to 10,000 rpm whereby the buffing head 23 and guide assembly 24 mounted on the rotating shaft 30 are rotated with the shaft. When pushed toward the ball G during rotation, the buffing head 23 and guide assembly 24 advance as one together with the rotating shaft 30. This pushing can be effected either by using the slide mechanism (35*a*) to move the support 37 in and out in the direction of the arrow C in FIG. 1, or by moving the rotating shaft 30 up and down, relative to the top plate 31 of the buffing means 22, in the direction of arrow B in FIG. 1.

Although not shown in the diagrams, the buffing head of the buffing means may be provided with a mechanism which imparts precession to the rotating shaft. This mechanism acts in such a way as to enable the buffing head to carry out buffing by a circular stroking motion over the top of the ball, which is highly effective for buffing away burrs that arise locally at the core support pin and venting pin positions.

In the golf ball buffing apparatus of the present invention, the buffing face on the buffing head and the following faces on the guide assembly are shaped to match the curved surface of the ball. As a result, when the guide assembly is brought up against the ball's surface during buffing, the buffing head is unable to advance substantially beyond this position, thereby reliably preventing extra buffing due to undesirable advance of the buffing head. This makes it possible to accurately buff only the selected regions which require deburring, eliminating excessive reduction in the depth of dimples on the ball's surface from buffing and avoiding the consequent loss of dimple effects on the flight performance of the ball.

The method for buffing golf balls according to the present invention which makes use of the above-described golf ball buffing apparatus involves the steps of (a) holding a golf ball with the holder means, (b) pushing the buffing means against the golf ball until the buffing face of the buffing head and the following face of the guide assembly come in contact with the ball surface, and (c) rotating the buffing head with the rotating shaft for buffing the golf ball with the buffing face.

In the buffing method shown in FIGS. 1 and 2, the buffing means 22 is disposed for linear motion toward and away from at least one polar area of the golf ball G. One alternative not shown in the diagrams is to have the golf ball G held near its equator by the holding means 21, and to provide a pair of buffing means 22 at both polar positions of the ball G. However, it is recommended that a single buffing means 22 be provided, as shown in FIG. 1, in a manner allowing it to move to and from one of the polar positions of the ball G (the north pole position in FIG. 1). In this case, burrs that are formed at both poles can be removed by first buffing the north pole region of the ball G, then rotating the ball 180 degrees and buffing the south pole region.

The burr that is formed at the venting pin position on the surface of the golf ball is actually in the shape of a ring centered on the pole point and having a small radius. While this burr can be buffed away in the above-described manner, it is advisable for better work efficiency to carry out buffing by setting the golf ball on the holding platform such that the axis passing through both poles of the ball is slightly out of alignment with the axis about which the buffing head of the buffing means rotates.

Figure 4:
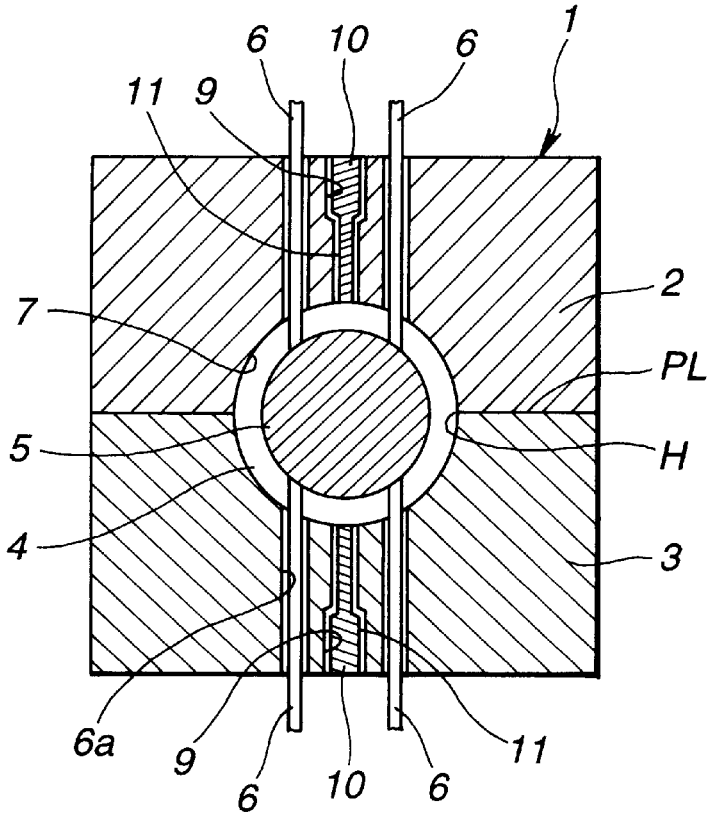
FIG. 4 is a sectional view of an injection mold such as may be used in connection with the prior art and the present invention.
Figure 5:
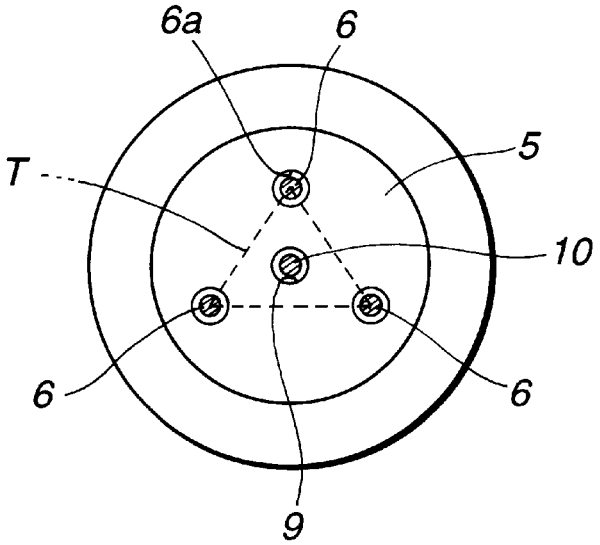
FIG. 5 is a plan view of the same mold as seen from a polar direction.
Figure 6:
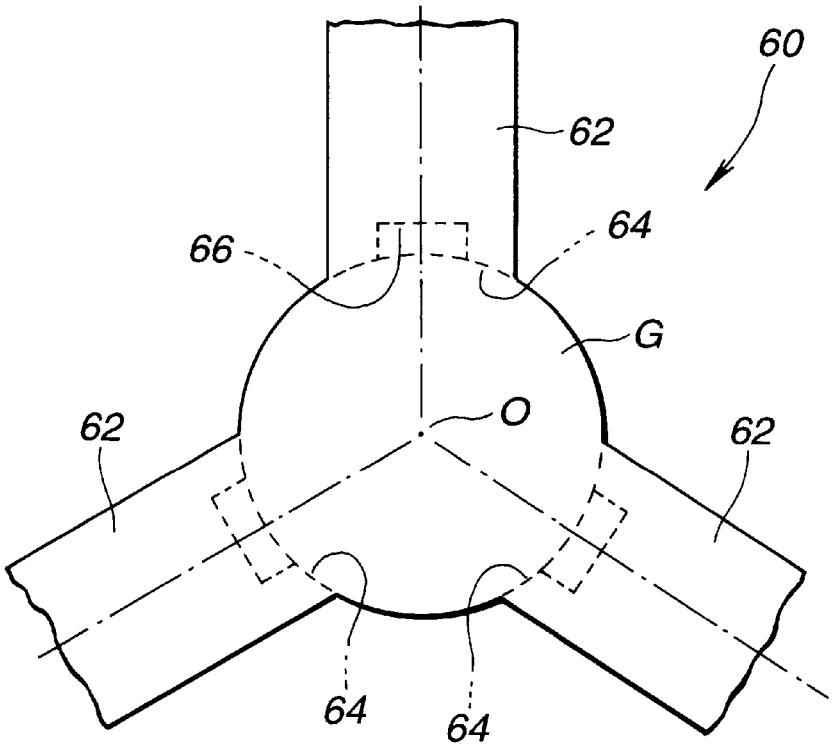
FIG.6 PRIOR ART
FIG. 6 is a schematic side view showing a prior art grinding apparatus.
Figure 7:
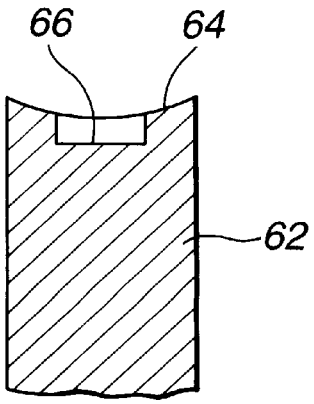
FIG.7 PRIOR ART
FIG. 7 is an axial cross-section of one shaft in the grinding apparatus shown in FIG. 6.

The golf ball buffing apparatus and method of the present invention are very suitable for properly buffing burrs that arise only at the core support pin and venting pin positions when the golf ball cover is injection molded over the core, as described earlier in conjunction with FIGS. 4 and 5. However, the inventive apparatus and method are not limited to use only in this way, and can also be applied with excellent results to the buffing of gate marks and other defects which form near the equator.

Where a concern exists that dimples may become shallower in areas over which the buffing head passes when the burrs are buffed down, this may be compensated for beforehand by making the dimples in these areas a little deeper.

The present invention is able to efficiently carry out buffing only in those areas of the golf ball surface that require deburring. In this way, it effectively overcomes the disadvantages of prior-art grinding methods, which uniformly grind not only those regions of the ball's surface having burrs, but even regions of the ball's surface without burrs, lowering the precision of the dimple depth on the surface, and resulting in a decline in the ball's flight performance so that, when hit, the ball tends to rise too sharply or deviate left or right.

A golf ball that has been buffed according to the present invention incurs substantially no loss in the surface shape (especially dimple depth) specified by the ball's design, and is thus able to fully display the intended dimple effects. The result is a high-quality ball endowed with a superb flight performance and an excellent appearance.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball buffing apparatus comprising:

means for holding a golf ball having an outside surface, and means for buffing the outside surface of the golf ball, the buffing means being movable toward and away from the golf ball and including a rotating shaft having an axis, a buffing head mounted on one end of the rotating shaft and having a buffing face shaped in substantial conformity with the outside surface of the golf ball, and a guide assembly having a following face that is disposed radially outward from the buffing head and substantially coincides with the extended shape of the buffing face;

wherein said buffing head and said guide assembly are mounted so that said buffing head and said guide assembly are movable together in the axial direction of the rotating shaft; and said guide assembly comprises a plurality of roller-shaped followers, each rotatable about a pivot, wherein the followers rotate over the ball and about the respective pivots, either together with rotation of the buffing head or independently thereof.

2. The golf ball buffing apparatus of claim 1, wherein the rotating shaft is mounted in an overhead support via a bearing, wherein the overhead support is connected with the base through supporting columns.

3. A method for buffing a golf ball, comprising the steps of:

(a) securely holding a golf ball having an outside surface with a holder means having a ball holding platform and ball retainers such that said golf ball is held to said platform;

(b) pushing buffing means against the golf ball, said buffing means being movable toward and away from the golf ball and including a rotating shaft, a buffing head mounted on one end of the rotating shaft and having a buffing face shaped in substantial conformity with the outside surface of the golf ball, and a guide assembly having a guide disc and a following member with a following at its lower end that is disposed radially outward from the buffing head and substantially coincides with the extended shape of the buffing face, and (c) rotating the rotating shaft, and hence the buffing head for buffing the golf ball with the buffing face.

4. A golf ball buffed by the method of claim 3.

5. A golf ball buffing apparatus comprising:

means for holding a golf ball having an outside surface, said means including a ball holding platform to set the golf ball thereon and ball retainers to fasten the golf ball to the ball holding platform, and means for buffing the outside surface of the golf ball, said buffing means being movable toward and away from the golf ball and including a rotating shaft having an axis, a buffing head mounted on one end of the rotating shaft and having a buffing face shaped in substantial conformity with the outside surface of the golf all, and a guide assembly having a guide disc and a plurality of follower members extending vertically downward from the periphery of the guide disc, wherein each of the follower members has a following face at its lower end that is disposed radially outward from the buffing head and substantially coincides with the extended shape of the buffing face; and wherein said buffing head and said guide assembly are mounted so that said buffing head and said guide assembly are movable together in the axial direction of the rotating shaft.

6. The golf ball buffing apparatus of claim 5, wherein the buffing head and guide assembly are mounted on the rotating shaft so that they rotate with the rotating shaft.

7. The golf ball buffing apparatus of claim 5, wherein the ball holding platform at its top side has a curved surface that corresponds with the surface shape of the golf ball.

8. The golf ball buffing apparatus of claim 5, wherein the ball holding platform is fastened on a base.

9. The golf ball buffing apparatus of claim 8, wherein the rotating shaft is mounted in an overhead support via a bearing, wherein the overhead support is connected with the base through supporting columns.

10. The golf ball buffing apparatus of claim 1, wherein the buffing head and guide assembly are mounted on the rotating shaft so that they rotate with the rotating shaft.

11. The golf ball buffing apparatus of claim 1, wherein the ball holding platform at its top side has a curved surface that corresponds with the surface shape of the golf ball.

12. The golf ball buffing apparatus of claim 1, wherein the ball holding platform is fastened on a base.

* * * * *